US010145566B2

(12) United States Patent
Di Tommaso

(10) Patent No.: US 10,145,566 B2
(45) Date of Patent: Dec. 4, 2018

(54) OVEN DOOR

(71) Applicant: TECNO S.P.A., Gualtieri (RE) (IT)

(72) Inventor: Antonio Di Tommaso, Bologna (IT)

(73) Assignee: TECNO S.P.A., Gualtieri (RE) (IT)

( * ) Notice: Subject to any disclaimer, the term of this patent is extended or adjusted under 35 U.S.C. 154(b) by 310 days.

(21) Appl. No.: 15/214,554

(22) Filed: Jul. 20, 2016

(65) Prior Publication Data

US 2017/0023259 A1 Jan. 26, 2017

(30) Foreign Application Priority Data

Jul. 21, 2015 (IT) ..... 102015000036264

(51) Int. Cl.
*F24C 15/04* (2006.01)
*F24C 15/02* (2006.01)

(52) U.S. Cl.
CPC ..... *F24C 15/023* (2013.01); *F24C 15/04* (2013.01)

(58) Field of Classification Search
CPC ..... F24C 15/04; F24C 15/023
USPC ..... 126/194, 198, 200
See application file for complete search history.

(56) References Cited

U.S. PATENT DOCUMENTS

| | | | | |
|---|---|---|---|---|
| 3,760,792 | A * | 9/1973 | White | F24C 15/04 126/198 |
| 4,041,930 | A | 8/1977 | Katona | |
| 4,043,091 | A | 8/1977 | Katona | |
| 4,206,338 | A | 6/1980 | Katona | |
| 4,253,286 | A * | 3/1981 | Katona | F24C 15/006 126/198 |
| 7,703,451 | B2 * | 4/2010 | Bang | F24C 15/022 126/190 |
| 9,750,088 | B2 * | 8/2017 | Hofmann | H05B 6/6405 |
| 9,913,323 | B2 * | 3/2018 | Houbloss | H05B 6/6414 |
| 2005/0028805 | A1 * | 2/2005 | Bronstering | F24C 15/045 126/194 |
| 2015/0245422 | A1 * | 8/2015 | Himmelein | H05B 6/763 219/740 |
| 2016/0209027 | A1 * | 7/2016 | Yoon | F23D 14/10 |

FOREIGN PATENT DOCUMENTS

WO 2015096865 A1 7/2015

* cited by examiner

*Primary Examiner* — Gregory Huson
*Assistant Examiner* — Nikhil Mashruwala
(74) *Attorney, Agent, or Firm* — Browdy and Neimark, PLLC

(57) ABSTRACT

A door (1) for an oven (100) for closing and opening a cooking chamber (120) of the oven (100), comprising a frame (20) able to be hinged to the oven (100), and a first panel (30) fixed to the frame (20), comprising at least a second panel (31,32) associated to the frame (20) removably by means of jointing fastening elements (24,213,222).

7 Claims, 6 Drawing Sheets

OVEN DOOR

TECHNICAL FIELD

The present invention relates to an oven door.

In particular, the invention relates to an oven door for domestic or professional kitchens and an oven comprising the door.

PRIOR ART

As is known, domestic or professional kitchens generally comprise at least an electric or gas oven for cooking foods.

These known ovens comprise a box body defining a cooking chamber and provided with a frontal access opening to the cooking chamber.

The known ovens further comprise a door hinged to the box body so as to be able to open and close the front access opening to the cooking chamber.

The known doors comprise a frame to which panels are associated, usually made of a transparent material, which on the one hand enable an operator to observe the inside of the cooking chamber, and on the other hand improve the heat insulation of the cooking chamber itself.

For example, oven doors are known provided with two or three panels parallel to one another and in particular with a first panel able to define a wall of the external door to the cooking chamber of the oven, an internal panel able to define a wall of the internal door to the cooking chamber, and an intermediate panel able to be interposed between the external panel and the internal panel.

In particular, the panels are fixed to the frame by screws, brackets or other fixing means which ensure a solid fastening to the frame of the door.

During use of the oven steams can exit, which contain substance loads that when contacting the door foul the panels of the doors and in some cases the steams can penetrate between one panel and another, fouling the intermediate panel and the surfaces of the external and internal panels facing towards the intermediate panel.

In this case, it is necessary to clean the panels in order to maintain a hygienic environment for the cooking of the foods inside the oven.

However, to clean the panels it is necessary to remove them from the frame by acting on the fixing means; this operation is often complex and laborious and can require much time and the use of adequate tools for removal of the jointing fastening elements.

Examples of known door are disclosed in documents WO2015/096865A1, U.S. Pat. Nos. 4,043,091A e 4,041,930A An aim of the present invention is to obviate the abovementioned drawbacks of the prior art, with a solution that is simple, rational and relatively inexpensive.

The aims are attained by the characteristics of the invention as reported in the independent claim. The dependent claims delineate preferred and/or particularly advantageous aspects of the invention.

DESCRIPTION OF THE INVENTION

An embodiment of the invention relates in particular to a door for an oven for closing and opening a cooking chamber of the oven, comprising a frame able to be hinged to the oven, and a first panel fixed to the frame.

In the invention, the door comprises at least a second panel associated to the frame removably by means of jointing-fastening snap-on elements.

Moreover, in the invention the jointing fastening elements comprise at least a pair of profiled members fixable to the frame, wherein each profiled member comprises at least a slot provided with a broadened portion able to insert on a pin fixed to the frame, and a tapered portion able to retain at least a portion of the pin by friction following a reciprocal sliding movement between the profiled member and the pin.

With this solution, the jointing fastening elements are easy and economical to realise and furthermore are easily freeable so as to enable a rapid removal and installation of the second panel to the frame.

With this solution, the second panel is fixed stably to the frame and at the same time can be removed simply and rapidly in order for cleaning operations of the door to be carried out, without the use of specific tools.

In a further aspect of the invention, each profiled member is provided with an abutting surface able to press against a respective surface of the at least a second panel so as to maintain the second panel in a position in a special seating afforded in the frame.

In this way the jointing fastening elements enable maintaining the second panel solidly in position in the respective seating afforded in the frame.

The profiles are advantageously specular to one another.

In this way, the profiled members can each be associated in a specific position in the frame and can be activated, for fixing and/or freeing thereof in the same direction and thus being easy and rapid to use.

In a further aspect of the invention, the door comprises a third panel removably associated to the frame, wherein the second panel is interposed between the first and the third panel, and wherein the third panel is removably associated to the frame by means of the jointing-fastening elements.

In this way, the heat insulation of the door is increased because of the third panel, which can be easily removable for washing, maintenance and replacement operations.

In a further aspect of the invention, the jointing fastening elements comprise a lower support, fixed to a lower portion of the frame, and an upper recess fashioned in an upper portion of the frame, wherein the third panel is provided with a lower edge able to rest by force of gravity on the lower support, and an opposite upper edge able to be inserted in the upper recess.

In this way, the panel is maintained stably in position in the frame and the fixing means are defined by simple elements that are easy to realise.

The upper recess is advantageously defined by an abutting surface, fashioned in the upper portion of the frame, and an elastic element fixed to the upper portion of the frame, the upper side of the third panel being interposable between the abutting surface and the elastic element, and in which the elastic element is able to maintain the third panel abutting against the abutting surface.

With this solution, the elastic element defines an entry for insertion of the upper surface of the third panel of the recess and, by effect of the elastic return, keeps the upper edge abutting against the abutting surface of the frame so as to maintain the third panel solidly in position.

In a further aspect of the invention, the lower support comprises a groove for accommodating the lower edge of the third panel, where the lower edge is able to insert substantially snugly in the groove.

With this solution, a jointing-fixing element is defined that is able to solidly retain the third panel fixed to the frame, and contemporaneously can easily be freed so as to enable removal or replacement of the third panel.

In a further aspect of the invention, the jointing fastening elements are of the bayonet type.

In this way, simple, effective and easily-releasable fixing means are provided.

The invention further relates to an oven for kitchens comprising a box body defining a cooking chamber and provided with a frontal access opening to the cooking chamber.

The oven comprises a door according to the invention, hinged to the box body and able to open or close the access opening to the cooking chamber.

BRIEF DESCRIPTION OF THE DRAWINGS

Further characteristics and advantages of the invention will emerge from a reading of the following description, provided by way of non-limiting example with the aid of the figures illustrated in the appended tables of drawings.

BEST WAY OF CARRYING OUT THE INVENTION

Figure 2:
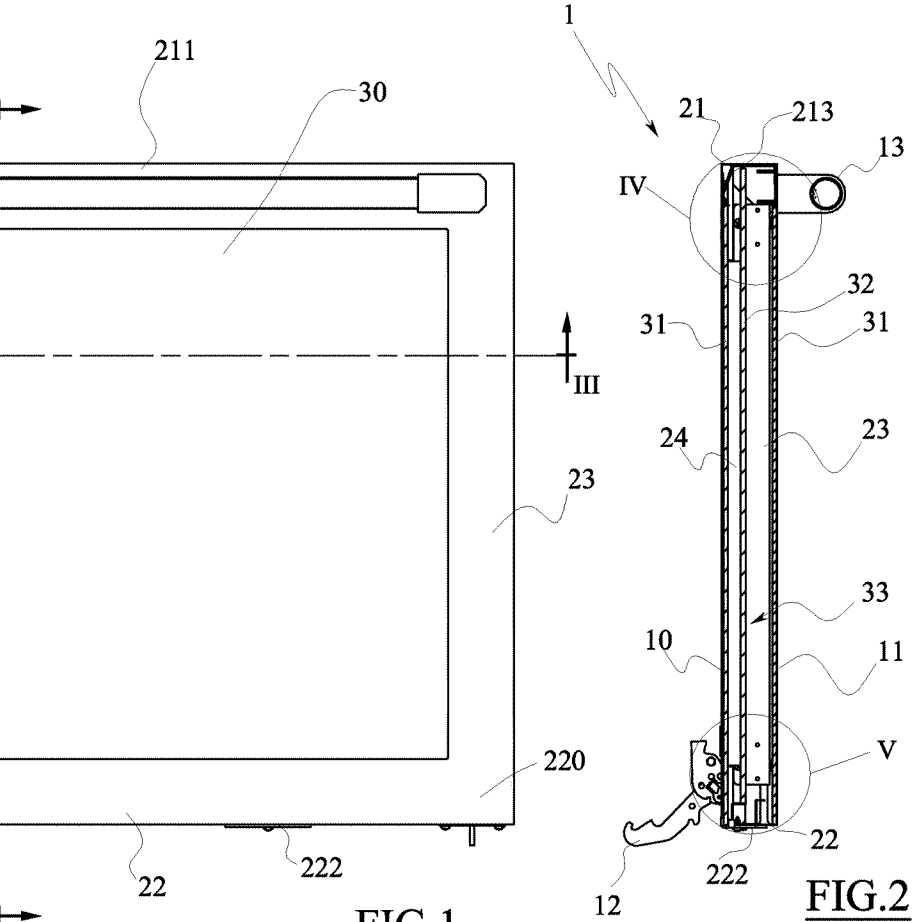
FIG. 2 is the section according to plane II-II of FIG. 1.
Figure 1:
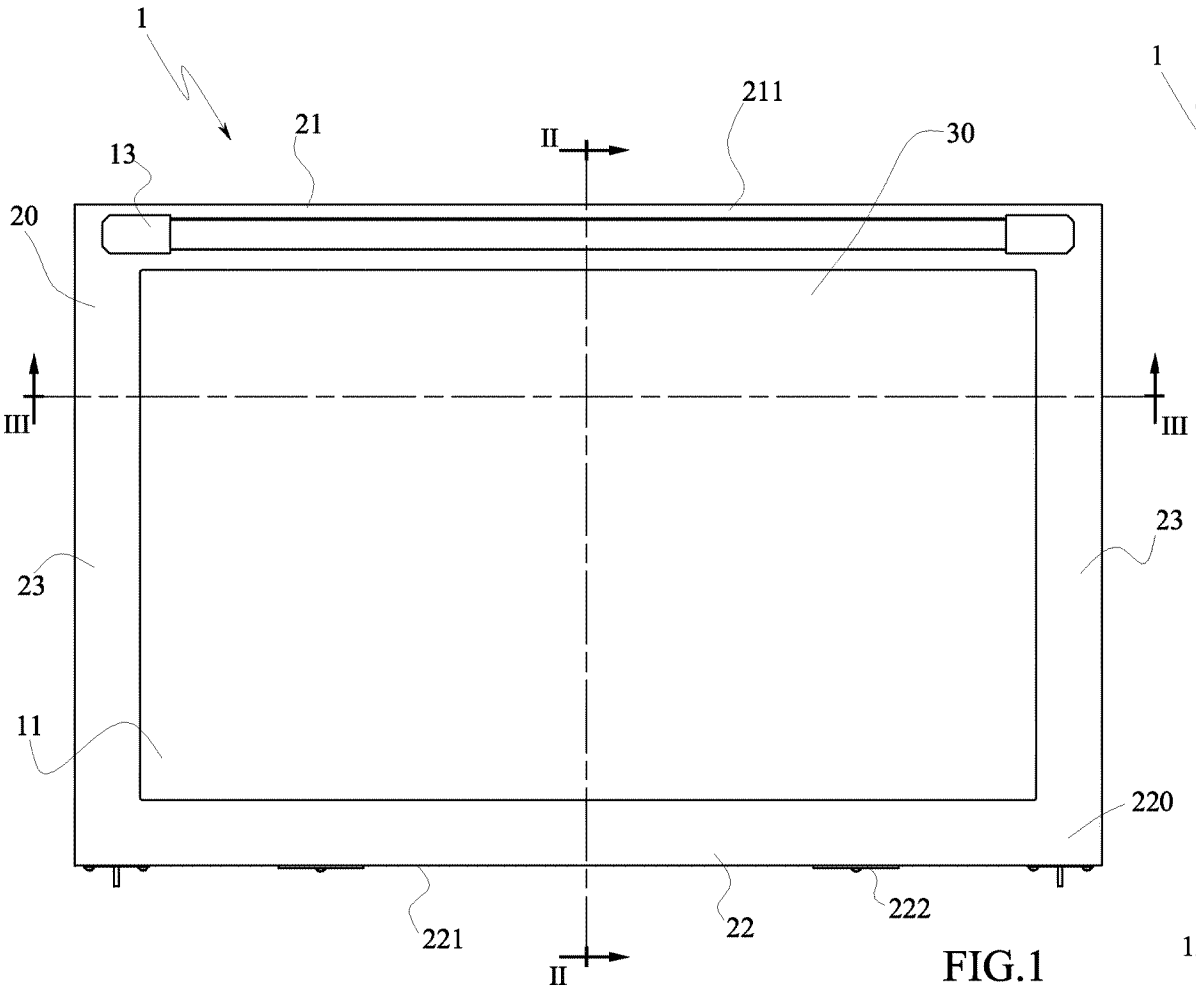
FIG. 1 is a front view of the door.
Figure 3:
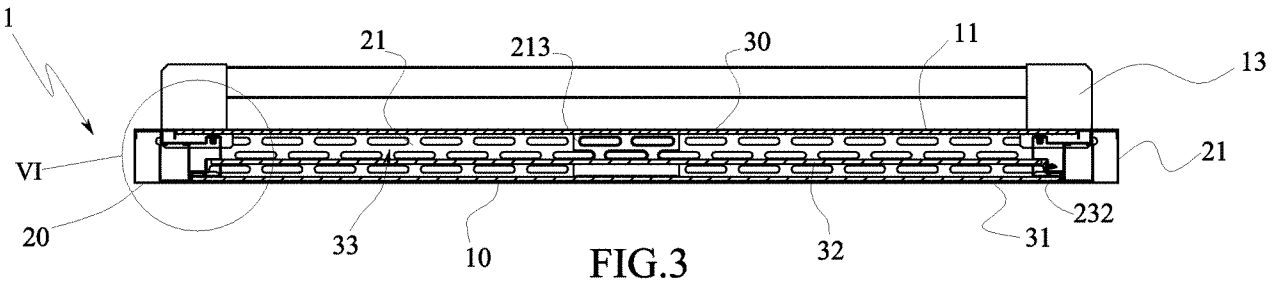
FIG. 3 is the section according to plane III-III of FIG. 1.
Figure 5:
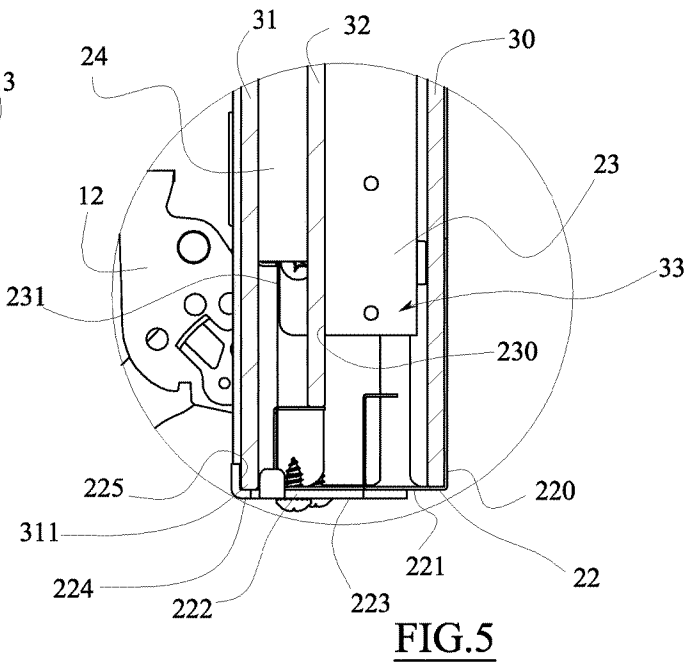
FIG. 5 is the section according to plane V of FIG. 2.
Figure 4:
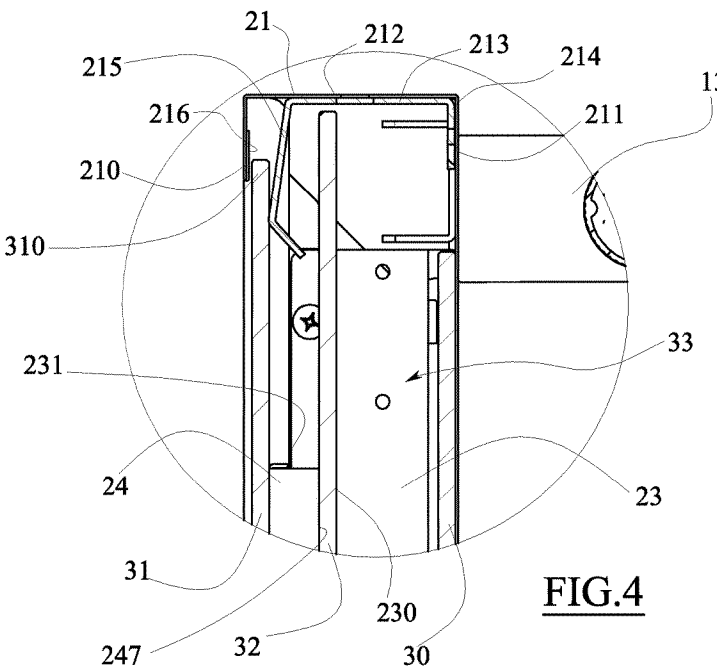
FIG. 4 is the section according to plane IV of FIG. 2.

With particular reference to the figures, reference numeral 100 denotes in its entirety an oven, for example electric or gas, for a kitchen for domestic or professional use.

Figure 11:
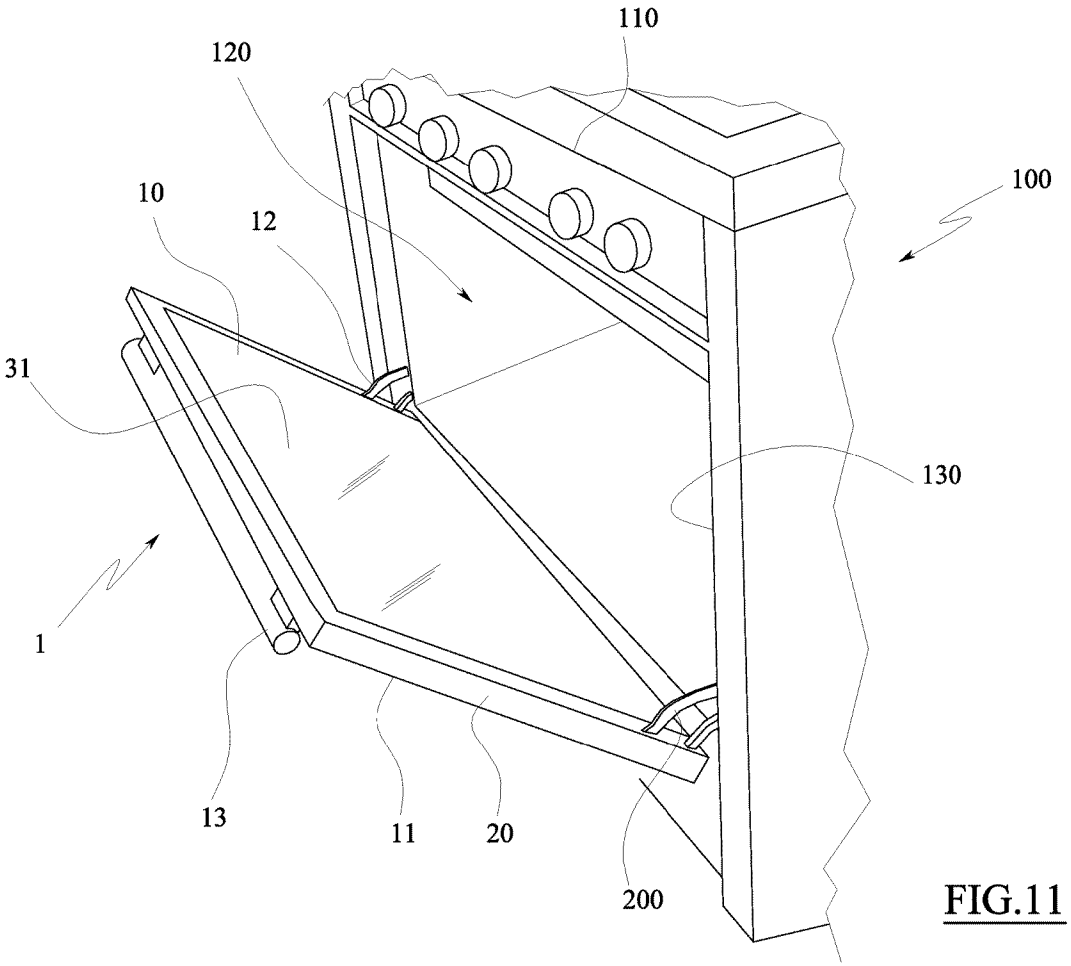
FIG. 11 is an axonometric view of an oven comprising the door of the invention.

The oven 100 comprises a box body 110, conformed for example as a cube or a parallelepiped, internally hollow and defining an internal cooking chamber 120 in which, for example, the gas burners or electrical resistances for cooking the foods are housed. (FIG. 11)

The box body is further provided with an access opening 130 to the cooking chamber 120 afforded, for example, on a frontal wall of the oven 100.

The oven 100 comprises a door 1, associated to the box body 110, provided with an internal face 10, i.e. able to be facing towards the inside of the cooking chamber 120, and an opposite external face 11, i.e. able to be facing towards the outside of the cooking chamber 120.

The door 1 is hinged to the box body 110, at the opening 130, and is able to assume an open configuration which affords access to the cooking chamber 120 and a closed configuration with prevents access to the cooking chamber 120.

In particular, in the embodiment illustrated in the figures, the door 1 can be hinged to the box body 110, by means of appropriate hinges 12, at a lower edge of the opening 130 so as to be able to pass from the open configuration to the closed configuration, and vice versa, rotating about a horizontal axis of the hinge.

In greater detail, the hinges 12 are associated to a lower portion of the internal face 10 of the door.

The door 1 further comprises a handle 13 enabling an operator to open and close the door, fixed to the external face 11 of the door.

The door 1 comprises a frame 20 substantially conformed as a frame, for example having a rectangular shape, able to support a plurality of panels 30,31,32 which will be more fully described in the following. (FIGS. 1 to 6)

The frame 20 is provided with a pair of cross-members 21,22 of which an upper cross-member 21 and an opposite lower cross-member 22 joined head to head with opposite lateral uprights 23.

In a further embodiment, the frame 20 can be realised in a single piece by cutting and bending a metal sheet.

The upper cross-member 21 of the frame 20 is elongate and can be fixed at each of the longitudinal ends thereof to a longitudinal end of a respective lateral upright 23.

The upper cross-member 21 is provided with a transversal section substantially having a C-shaped section with a concavity thereof facing towards the inside of the border, defined by the frame 20, and in particular is provided with a first and a second end part 210,211 and an intermediate part 212.

In greater detail, the first end part 210 and the second end part 211 are parallel to one another and respectively define a portion of the internal face 10 of the door 1 and a portion of the external face 11 of the door 1.

The upper cross-member 21 further comprises an elastic element 213 housed in the concavity of the C-shaped conformation.

The elastic element 213 comprises a base portion 214 fixed, for example, to the intermediate part 212 and/or the second end part 211 of the upper cross-member 21, and comprises a flexible part 215 fixed to the base 214 and located substantially abutting against an abutting surface 216 defined by the surface of the first end part 210 internal of the concavity of the upper cross-member 21.

In the embodiment illustrated in the figures, the base portion 214 of the elastic element 213 is substantially L-conformed and is fixed, for example welded, to the intermediate part 212 and the second end part 211.

The flexible portion 215 of the elastic element 213 is conformed as an elongate elastic tongue arranged diagonally between the intermediate part 212 and the first end part 210 and having an end fixed to the base portion 214, at the intermediate part 210, and a free opposite end located in abutment against the abutting surface 216.

The free end of the flexible portion 215 preferably projects from the concavity of the upper cross-member 21, and is bent internally of the border defined by the frame 20 so as to define an entry surface.

In this way, by deforming the elastic element 213, by application of an appropriate force, a recess is defined between the flexible portion 215 and the abutting surface 216, which recess is for housing a portion of one of the panels 30,31,32 as will be more fully described in the following.

The lower cross-member 22 of the frame 20 is elongate and able to be fixed at each of the longitudinal ends thereof to a longitudinal end of a respective lateral upright 23.

The lower cross-member 22 is provided with a substantially L-shaped transversal section having a concavity thereof facing towards the inside of the border defined by the frame 20 and, in particular, is provided with a first portion 220 able to define a portion of the external face 11 of the door 1, and a second portion 221, perpendicular to the first portion 220 and able to define a lower side of the door 1.

At least a support bracket 222 for one of the panels 30,31,32 is fixed, for example by appropriate fastening screws, to the lower cross-member 22.

In the embodiment shown in the figures, a pair of support brackets 222 is fixed to the lower cross-member 22.

Each support bracket 222 comprises a first base end 223 fixed to the second portion 221 of the lower cross-member 22, and a second end 224 which projects towards the inside of the border defined by the frame 20, on the opposite side with respect to the first portion 220, i.e. substantially at the internal face 10 of the door 1.

The second end 224 comprises a groove 225 able to house a portion of a side of one of the panels 30,31,32, which lies on the plane of the internal face 10 of the door 1.

In particular, each groove 225 has a substantially identical thickness to that of the portion of panel 30,31,32 to be housed and is able to retain the panel 30,31,32 by friction. Each lateral upright 23 is elongate in shape and is provided with a tapered section towards the internal face 10 of the door.

In particular, each lateral upright 23 comprises a first and a second step 230,231 fashioned on the side of the lateral upright 23, which can be facing towards the inside of the border defined by the frame 20.

In greater detail, each step 230,231 is defined by a surface parallel to the lie plane of the frame 20 and in particular the first step 230 is arranged proximal to the external face 11 of the door 1, while the second step 231 is arranged proximal to the internal face 10 of the door 1.

Further, the first step 230 projects with respect to the second step 231 towards the inside of the border defined by the frame 20.

The first steps 230 of each lateral upright 23 are able to define a seating for one of the panels 30,31,32 as will be more fully described in the following.

The surface of the first step 230 is advantageously clad with a soft material, for example rubber or felt so as not to damage the surface of the panel 30,31,32 resting on the surface of the first step 230.

Each lateral upright 23 further comprises pins 232 fixed to the second step 231 the function of which will be more fully described in the following.

In particular, each lateral upright 23 comprises a pair of pins 232 aligned along the longitudinal direction of the lateral upright 23.

Each pin 232 is substantially mushroom-shaped and is provided with a stem 233, for example cylindrical, fixed to the surface of the second step 231, of the respective lateral upright 23, having an axis perpendicular to the surface of the second step 231, and a broadened head 234, for example disc-shaped, fixed superiorly to the stem 233.

The frame 20 further comprises profiled members 24 able to be associated to the lateral uprights 23.

Figures 6, 7, 8, 9:
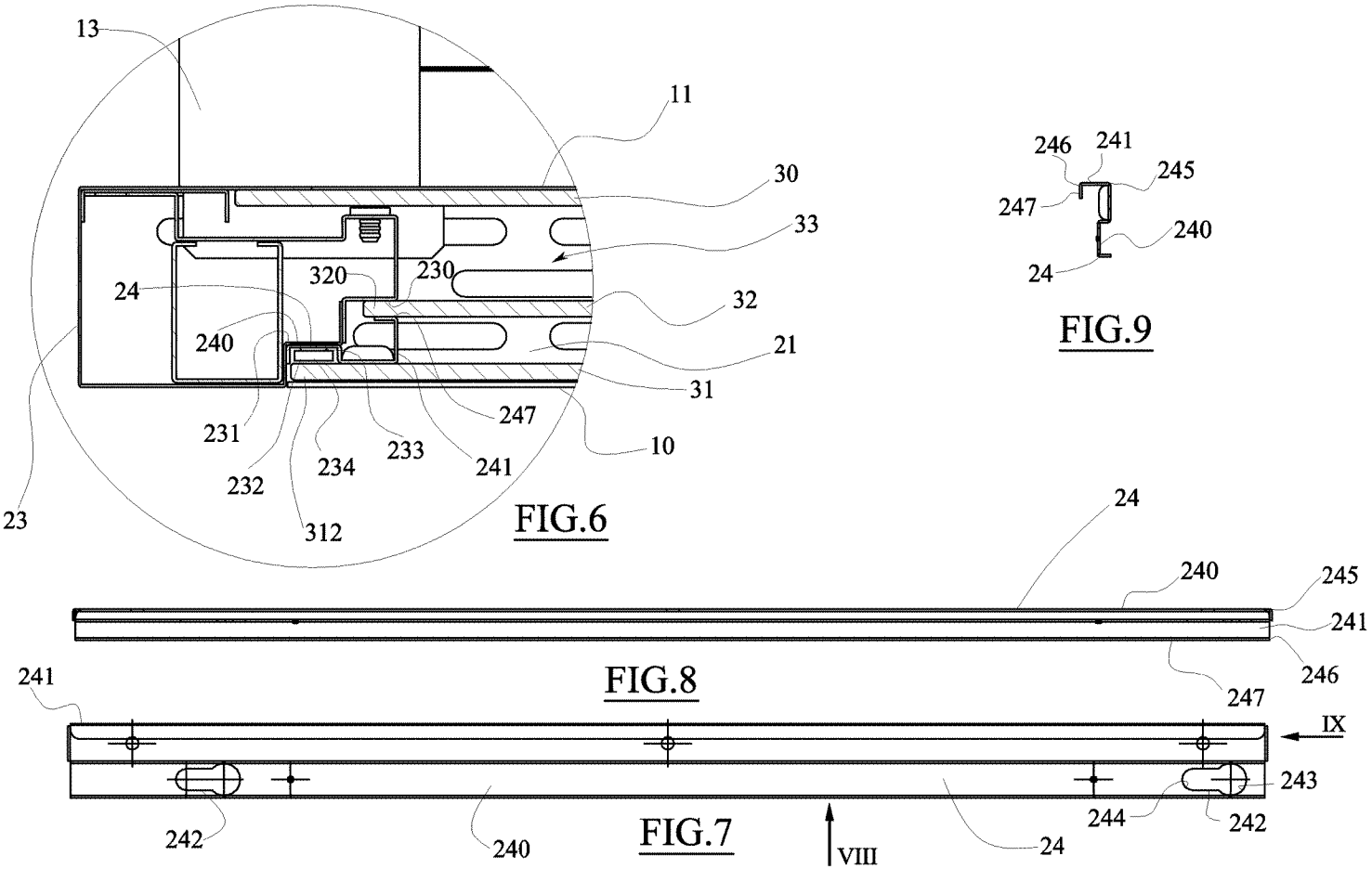
FIG. 6 is the section according to plane VI of FIG. 3.
FIG. 7 is a front view of a profiled member.
FIG. 8 is the view along VIII of FIG. 7.
FIG. 9 is the view along IX of FIG. 7.
Figure 10B:
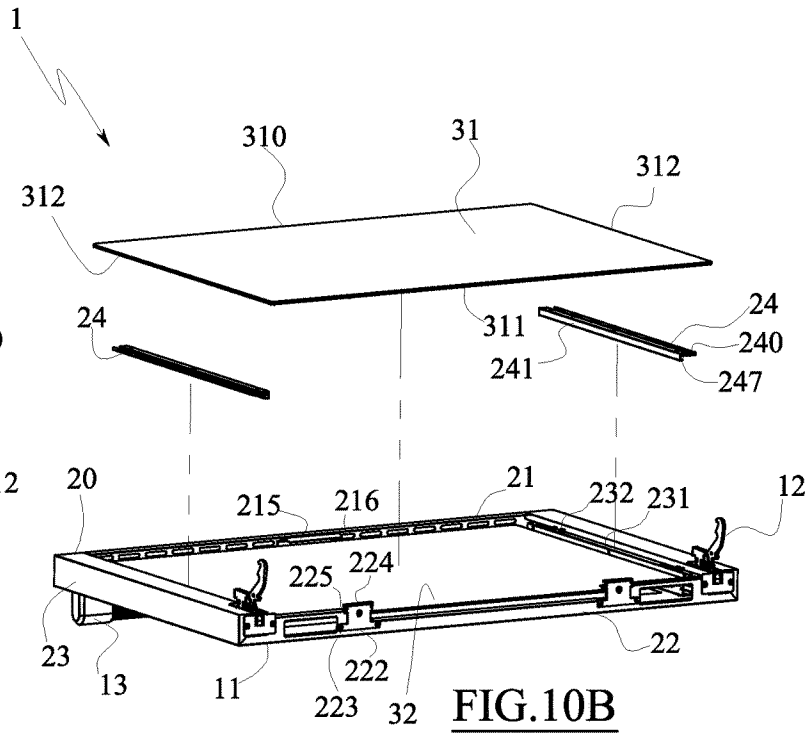
FIG. 10B is an exploded axonometric view of the door 1 in a second configuration.
Figure 10A:
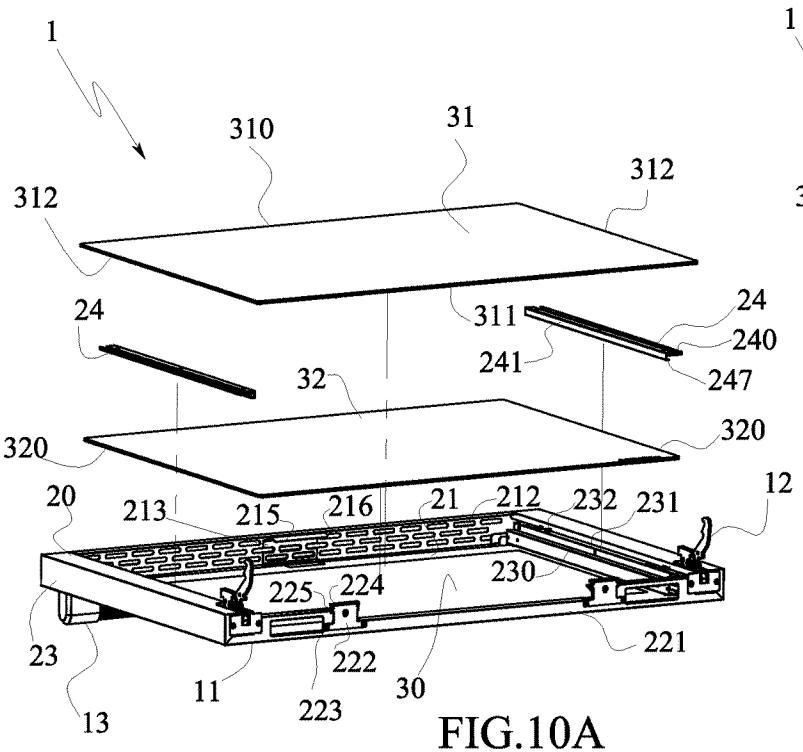
FIG. 10A is an exploded axonometric view of the door 1 in a third configuration.
Figure 10D:
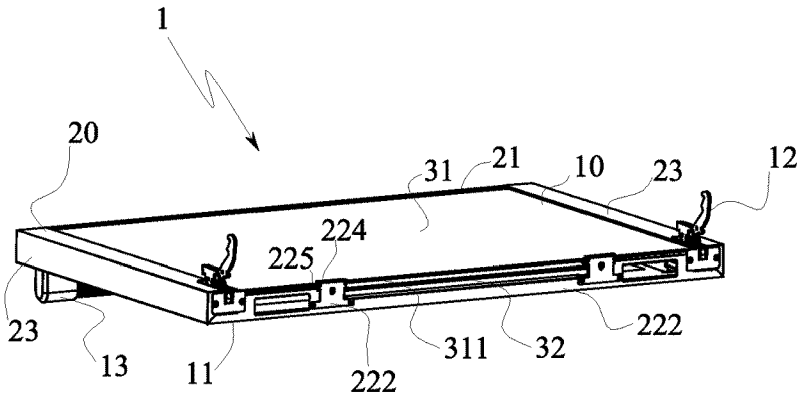
FIG. 10D is an exploded axonometric view of the door 1 in a fourth configuration.
Figure 10C:
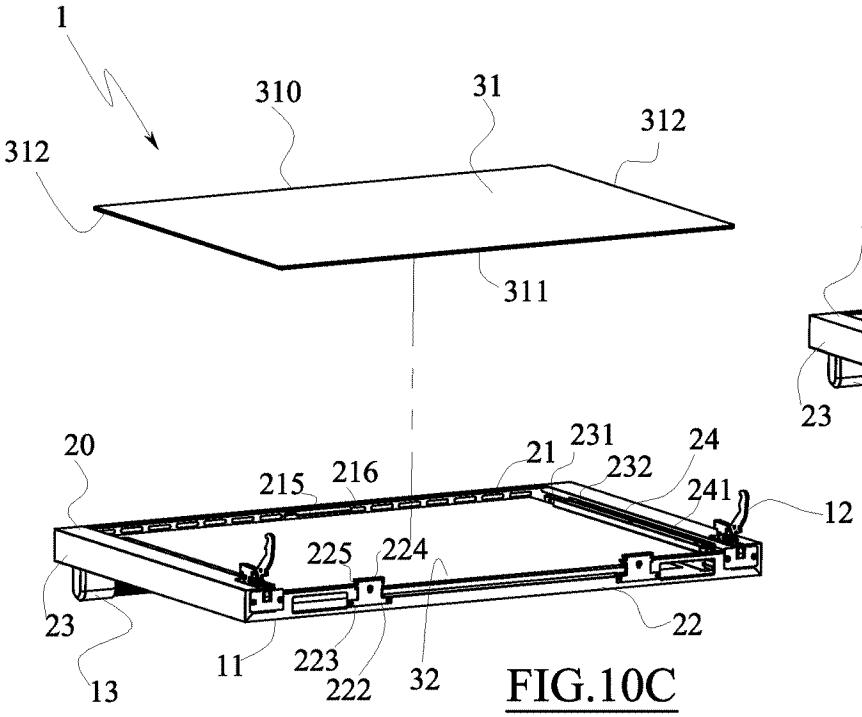
FIG. 10C is an exploded axonometric view of the door 1 in a third configuration.

In the embodiment illustrated in the figures, the frame 20 comprises a pair of profiled members 24, in which each profiled member 24 can be associated to a respective lateral upright 23. (FIGS. 7 to 9)

Each profiled member 24 is elongate and has a profiled transversal section, for example substantially in an L-shape, and comprises a first portion 240, able to be associated to the surface of the second step 231 of the respective lateral upright 23, and a second portion 241, perpendicular to the first portion 240 and able to project towards the first step 230.

The first portion 240 comprises at least a through-slot 242 that can be associated to one of the pins 232 of the second step 231.

In particular, the first portion 240 comprises a plurality of slots 242, i.e. a slot 242 for each pin 232.

Each slot 242 is conformed such as to define a snap-fit joint with the respective pin 232, for example a bayonet joint, and in particular is provided with a broadened portion 243 having a larger diameter than the broadened head 214 of the respective pin 212, and a tapered portion 244, elongate and in communication with the broadened portion 243, having a smaller width than the width of the diameter of the broadened head 234 of the pin 232 and substantially equal to, or slightly larger, than the diameter of the stem 233 of the pin 212.

Further, the thickness of the first portion 240 is substantially identical to or slightly smaller than the height of the stem 233.

The second portion 241 of each profiled element 24 comprises a first end 245 fixed to the first portion 240 and an opposite free second end 246 able, when the spacer 24 is associated to the respective lateral upright 23, to be arranged at a predetermined distance from the first step 230 of the lateral upright 23.

In particular, the distance between the second end 246 of the second portion 241 and the surface of the first step 210 is substantially identical to the thickness of one of the panels 30,31,32.

The second end 246 of the second portion 241 advantageously comprises a flap bent substantially by 90° with respect to the first portion and defining an abutting surface 247 able, in use, to be facing towards the respective first step 210. The abutting surface 247 of the bent flap is preferably clad with a soft material, for example rubber or felt.

Each profiled member 24 can slide along a parallel direction to the lie plane of the frame 20 between a free configuration in which the broadened portion 243 of the slots 242 is superposed in plan view on the broadened head 234 of the pins 232 and the profiled member is free to move along a perpendicular direction to the lie plane of the frame 20, and a constrained configuration in which the tapered end 244 is superposed in plant view on the broadened head 234 of the pins 232, retaining the stem 233 by friction, and in which the profiled member is constrained in this configuration, being prevented from making any movement either perpendicular or parallel to the lie plane of the frame 20.

The profiled members 24 are advantageously specular to one another so as each to be associated to a specific lateral upright 23, and to be activatable between the free configuration and the constrained configuration in the same direction.

As described in the foregoing, the door 1 comprises a plurality of panels 30,31,32 having a rectangular shape, for example made of hardened glass, fixable to the frame 20.

The door 1 comprises a first panel 30 fixable, for example unremovably, to the frame 20 so as to define the external face 11 of the door 1.

In particular, the first panel 30 can be fixed internally of the border defined by the frame 20 at the external sides of the cross-members 21,22 and the lateral uprights 23 so as to be substantially flush with the external surface of the frame 20.

The door 1 further comprises a third panel 31 fixable, for example removably, to the frame 20 so as to define the internal face 10 of the door 1.

In particular, the third panel 31 can be fixed internally of the border defined by the frame 20 at the internal sides of the cross-members 21,22 and the lateral uprights 23 so as to be substantially flush with the external surface of the frame 20.

In greater detail, the third panel 31 comprises an upper border 310 insertable in the recess defined between the abutting surface 216 of the upper cross-member 21 and the flexible portion 215 of the elastic element 213 and a lower border 311 that can be housed in the grooves 225 of the support brackets 222.

Further, the third panel 31 comprises opposite lateral borders 312 able to rest on the lateral profiled members 23, for example on the second steps 231, in particular on the broadened heads 234 of the pins 232 of the lateral profiled members 23.

The third panel 31 can slide along a parallel direction to the lie plane thereof between a first position in which the lower edge 311 is inserted substantially snugly, for example retained by friction, in the grooves 225, of the support brackets 222, and the upper edge 310 is distal from the intermediate part 212 of the upper cross-member 21, and a second position in which the lower edge 311 is extracted from the grooves 225 of the support brackets 222, and the upper edge 310 is in contact with the intermediate part 212 of the upper cross-member 21.

In this way, the first and the third panel 30,31 are parallel to one another and distanced by a distance that is substantially equal to the thickness of the frame 20 and between them a compartment 33 is defined for air convention, enabling heat insulation of the oven 100.

In the embodiment illustrated in the figures, the door 1 further comprises a second panel 32 associable to the frame 20 internally of the compartment 33.

The second panel 32 can be interposed parallel to the first and the third panel 30,31 internally of the compartment 33 and, in particular, is arranged equidistant from the first and the third panel 30,31.

In greater detail, the second panel 31 comprises opposite lateral edges 320, each of which can rest on the surface of a respective first step 230 of the lateral uprights 23.

The second panel 32 is maintained in the seating, defined by the first steps 230, the abutting surfaces 247 of the profiled members 24.

The functioning of the door 1, as described above, is the following.

When the door 1 is in the open configuration, the third panel 31 can be activated, for example manually, slidingly from the first to the second position in such a way as to extract the lower edge 311 of the third panel 31 from the grooves 225 of the support brackets 222.

When the third panel 31 is in the second position the lower edge 311 can be gripped and raised manually, by tilting the third panel 31.

In this way, the lower edge 311 of the third panel 31 is raised upwards, while the upper edge 310 is activated downwards, pressing on the flexible portion 215 of the elastic element 213, which is deformed under the effect of the pressure.

At this point the third panel 31 can be extracted from the frame 20 and, in particular, the upper edge 310 of the second panel can be extracted from the recess defined by the flexible portion 215 of the elastic element 213 and from the abutting surface 216 of the upper cross-member 21.

The third panel 31 can thus be simply removed by extracting it upwards, by raising it along a substantially perpendicular direction to the lie plane of the door 1 and therefore the manoeuvring space for the mounting and de-mounting of the door 1 is considerably contained.

Once the third panel 31 has been removed both surfaces can be washed to remove the dirt that has settled on the third panel 31 during use of the oven 100.

Once the third panel 31 has been removed the profiled members 24 can be removed, activating them from the constrained configuration to the free configuration and de-inserting them from the pins 232.

Once the profiled members 24 have been removed the second panel 32 can also be removed simply by raising it along a substantially perpendicular direction to the lie plane of the door, so as to wash both the surfaces.

When the second panel 32 is removed from its seating, defined by the first steps 230, the internal surface of the first panel 30 can be washed.

When the washing operations have been completed it is sufficient to position the second panel 32 in the seating thereof, by resting it on the first steps 230 and fastening it in that position using the fixing means defined by the profiled members 24.

In particular, the profiled members 24 are rested on respective second steps 231 of the lateral uprights 23, so that the second portions 241 enter into contact with the second panel 32 and the slots 242 insert on the pins 232.

At this point the profiled members 24 can be activated from the free configuration to the constraining configuration so as to realise the joint with the pins 232 and maintain the second panel 32 solidly in position in the frame 20.

Once the installation of the second panel 32 is complete, the third panel 31 can be installed by inserting the upper edge 310 in the recess defined by the flexible portion 215 of the elastic element 213 and by the abutting surface 216 of the upper cross-member 21, by deforming the elastic element 213.

When the third panel 31 is in the second position, i.e. when the upper edge 310 is in contact with the intermediate part 212 of the upper cross-member 21, it can be activated slidingly towards the first position in which the lower edge 311 is inserted in the grooves 225 of the support brackets 222; in this position the elastic element 213 maintains the upper edge 310 in contact with the abutting surface 226.

At this point the door 1 thus-assembled can be returned into the closed position.

The invention as it is conceived is susceptible to numerous modifications, all falling within the scope of the inventive concept.

Further, all the details can be replaced with other technically-equivalent elements.

In practice the materials used, as well as the contingent shapes and dimensions, can be any according to requirements, without forsaking the scope of protection of the following claims.

The invention claimed is:

1. A door for an oven for closing and opening a cooking chamber of the oven, comprising a frame able to be hinged to the oven, a first panel fixed to the frame, and at least a second panel associated to the frame removably by jointing fastening elements, wherein the jointing fastening elements comprise at least a pair of profiled members fixable to the frame, wherein each profiled member comprises at least a slot provided with a broadened portion able to insert on a pin fixed to the frame, and a tapered portion able to retain at least a portion of the pin by friction following a reciprocal sliding movement between the profiled member and the pin, wherein each profiled member is provided with an abutting surface able to press against a respective surface of the second panel so as to maintain the second panel in a position in a special seating defined in the frame.

2. The door of claim 1, wherein the profiled members are reciprocally specular.

3. The door of claim 1, further comprising a third panel removably associated to the frame, wherein the second panel is interposed between the first and the third panel, and wherein the third panel is removably associated to the frame by means of the jointing fastening elements.

4. The door of claim 3, wherein the jointing fastening elements comprise a lower support, fixed to a lower portion of the frame, and an upper recess fashioned in an upper portion of the frame, wherein the third panel is provided with a lower edge able to rest by force of gravity on the lower support, and an opposite upper edge able to be inserted in the upper recess.

5. The door of claim 4, wherein the upper recess comprises an abutting surface, defined in the upper portion of the frame, and an elastic element fixed to the upper portion of the frame, the upper edge of the third panel being interposable between the abutting surface and the elastic element, and wherein the elastic element is able to maintain the third panel abutting against the abutting surface.

6. The door of claim 4, wherein the lower support comprises a groove able to substantially snugly accommodate the lower edge of the third panel.

7. An oven for kitchens comprising a box body defining an internal cooking chamber provided with an access opening to the cooking chamber, further comprising a door, according to claim 1, hinged to the box body and able to open or close the access opening to the cooking chamber.

* * * * *